US012600588B2

(12) United States Patent
Vu

(10) Patent No.: US 12,600,588 B2
(45) Date of Patent: Apr. 14, 2026

(54) DOCUMENT CONVEYING APPARATUS CAPABLE OF CORRECTING DOCUMENT SKEW

(71) Applicant: KYOCERA Document Solutions Inc., Osaka (JP)

(72) Inventor: Hung Manh Vu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 253 days.

(21) Appl. No.: 18/495,635

(22) Filed: Oct. 26, 2023

(65) Prior Publication Data

US 2024/0140747 A1 May 2, 2024

(30) Foreign Application Priority Data

Oct. 27, 2022 (JP) ..... 2022-172441

(51) Int. Cl.
*B65H 9/00* (2006.01)

(52) U.S. Cl.
CPC ... *B65H 9/002* (2013.01); *B65H 2404/15212* (2013.01); *B65H 2511/24* (2013.01)

(58) Field of Classification Search
CPC ..... B65H 9/04; B65H 9/004; B65H 9/006; B65H 9/008
See application file for complete search history.

(56) References Cited

U.S. PATENT DOCUMENTS 8,973,918 B2 * 3/2015 Muramatsu ..... B65H 5/062 271/253
10,703,596 B2 * 7/2020 Yoshita ..... B65H 3/0661
2015/0175369 A1 6/2015 Murata et al.

FOREIGN PATENT DOCUMENTS

JP 2015124015 A 7/2015

* cited by examiner

*Primary Examiner* — Howard J Sanders
(74) *Attorney, Agent, or Firm* — Alleman Hall LLP

(57) ABSTRACT

A document conveying apparatus includes a correction roller, a correction portion, a biasing portion, and a regulating portion. The correction roller has a rotating shaft, and a pair of contact portions arranged spaced apart on the rotating shaft, each including contact pieces extending in radial directions from the same circumferential positions, and each capable of coming in contact with a leading edge of a document conveyed on a conveying path. The correction portion allows the correction roller to rotate only when the leading edge of the document comes in contact with both of the pair of contact portions and the skew of the document is corrected. The biasing portion biases the correction roller in a rotational direction of the correction roller. The regulating portion regulates rotation of the correction roller biased by the biasing portion so as to retract the contact pieces of the contact portions from the conveying path.

3 Claims, 12 Drawing Sheets

DOCUMENT CONVEYING APPARATUS CAPABLE OF CORRECTING DOCUMENT SKEW

INCORPORATION BY REFERENCE

This application is based upon and claims the benefit of priority from the corresponding Japanese Patent Application No. 2022-172441 filed on Oct. 27, 2022, the entire contents of which are incorporated herein by reference.

BACKGROUND

The present disclosure relates to a document conveying apparatus capable of correcting skew of a conveyed document.

A document conveying apparatus, in some cases, may be provided with a registration roller pair for correcting the skew of a conveyed document. Rotation of the registration roller pair is stopped until a leading edge of the document comes into contact with the registration roller pair. When the leading edge of the document comes in contact with the registration roller pair, the document bends and the skew of the document is corrected. After that, the registration roller pair starts rotating to convey the document toward a downstream side.

SUMMARY

A document conveying apparatus according to the present disclosure includes a conveying path, a correction roller, a correction portion, a biasing portion, and a regulating portion. In the conveying path, a document is conveyed along a predetermined conveying direction. The correction roller has a rotating shaft along a width direction perpendicular to the conveying direction, and a pair of contact portions including contact pieces that are arranged on the rotating shaft spaced apart in the width direction and extending in radial directions from same positions in a circumferential direction, each of the contact portions being capable of coming in contact with a leading edge of a document conveyed on the conveying path. The correction portion allows the correction roller to rotate due to a document conveying force applied to the pair of contact portions only in a case where skew of the document is corrected by the leading edge of the document conveyed on the conveying path coming in contact with both of the pair of contact portions. The biasing portion biases the correction roller in a rotational direction in which the correction roller is rotated by the document conveying force. The regulating portion regulates rotation of the correction roller biased by the biasing portion so as to retract the contact pieces of the contact portions from the conveying path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

A document conveying apparatus of an embodiment according to the present disclosure will be described below with reference to the drawings.

Figure 1:
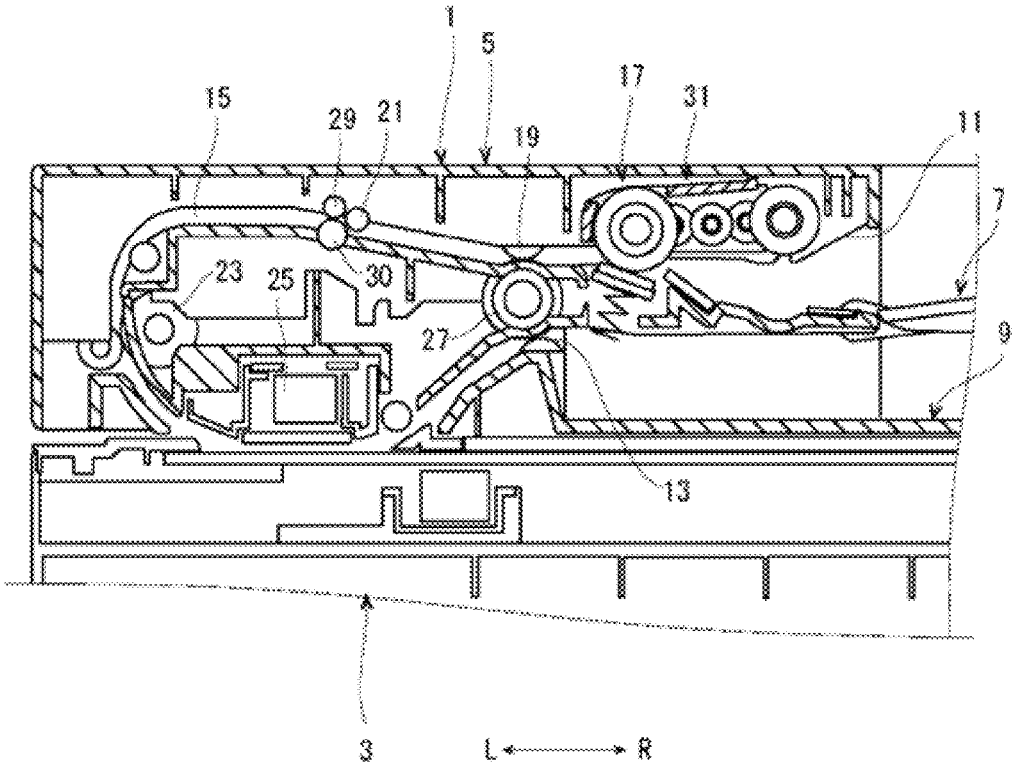
FIG. 1 is a front view schematically showing an internal configuration of a document conveying apparatus of an embodiment according to the present disclosure.

First, referring to FIG. 1, an overall configuration of the document conveying apparatus 1 according to the present embodiment will be described. FIG. 1 is a cross-sectional view schematically showing an internal structure of the document conveying apparatus 1. In the following description, a front side (front side) of the document conveying apparatus 1 is defined as the front side of the paper of FIG. 1. Fr, Rr, L, and R in each figure indicate a front side, a rear side, a left side, and a right side of the document conveying apparatus 1, respectively.

The document conveying apparatus 1 is placed, for example, on an upper surface of a document reading apparatus 3. The document conveying apparatus 1 automatically conveys a document and reads an image on one side of the conveyed document. The document reading apparatus 3 reads an image on an other surface of the document conveyed by the document conveying apparatus 1. The read image is formed on paper by, for example, an image forming apparatus (not shown).

The document conveying apparatus 1 includes a conveying portion 5 for reading an image while conveying a document, a document tray 7 on which a document whose image is read by the conveying portion 5 is placed, and a discharge tray 9 on which documents whose images have been read by the conveying portion 5 are stacked.

A sheet feed port 11 and a discharge port 13 are formed on a right side surface of the conveying portion 5. The discharge port 13 is formed below the sheet feed port 11. Between the sheet feed port 11 and the discharge port 13, a conveying path 15, having a horizontal U-shape when viewed from the front side, is formed. The direction in which the document is conveyed along the conveying path 15 from the sheet feed port 11 toward the discharge port 13 is defined as a conveying direction X of the document, and the direction orthogonal to the conveying direction X is defined as a width direction W (front-rear direction in this example).

In the conveying path 15, a sheet feed unit 17, a first conveying roller pair 19, a skew correction mechanism 21, a second conveying roller pair 23, a reading portion 25, and a discharge roller 27 are provided in that order from an upstream side in the conveying direction X. The sheet feed unit 17 is provided at the sheet feed port 11, and the discharge roller 27 is provided at the discharge port 13. In addition, a pinch roller 29 and a drive roller 30 are provided farther in a vicinity of a downstream side in the conveying direction X than the skew correction mechanism 21. The pinch roller 29 is rotatably held, positioned in the conveying direction X, movable with respect to the opposing driving roller 30, and is pressed against the drive roller 30 by a biasing member (not shown). The drive roller 30 rotates in the conveying direction X by being driven by a driving source (not shown) that is the same as that of the first conveying roller pair 19 and the second conveying roller pair 23.

Next, a document conveying operation will be simply described. When a stack of documents is placed on the document tray 7, the sheet feed unit 17 feeds the top document of the stack of documents from the sheet feed port 11 to the conveying path 15. The fed document is conveyed by the first conveying roller pair 19, corrected for skew by the skew correcting mechanism 21, and nipped between the pinch roller 29 and the drive roller 30 in a skew corrected state. After that, the document is conveyed along the conveying path 15 by the second conveying roller pair 23. When the document is conveyed to the reading portion 25, the reading section 25 reads an image on one surface of the document. After that, the document is discharged from the discharge port 13 by the discharge roller 27 and stacked on the discharge tray 9.

A configuration is known in which skew of a document is corrected using a registration roller pair driven by an electromagnetic clutch.

However, in a case where the electromagnetic clutch is provided, the cost of the document conveying apparatus increases. For this reason, it is desired that low-priced document conveying apparatus models do not include an electromagnetic clutch.

On the other hand, in the document conveying apparatus 1 of the embodiment according to the present disclosure, it is possible, as will be described below, to correct the skew of the document without using an electromagnetic clutch.

Figure 2:
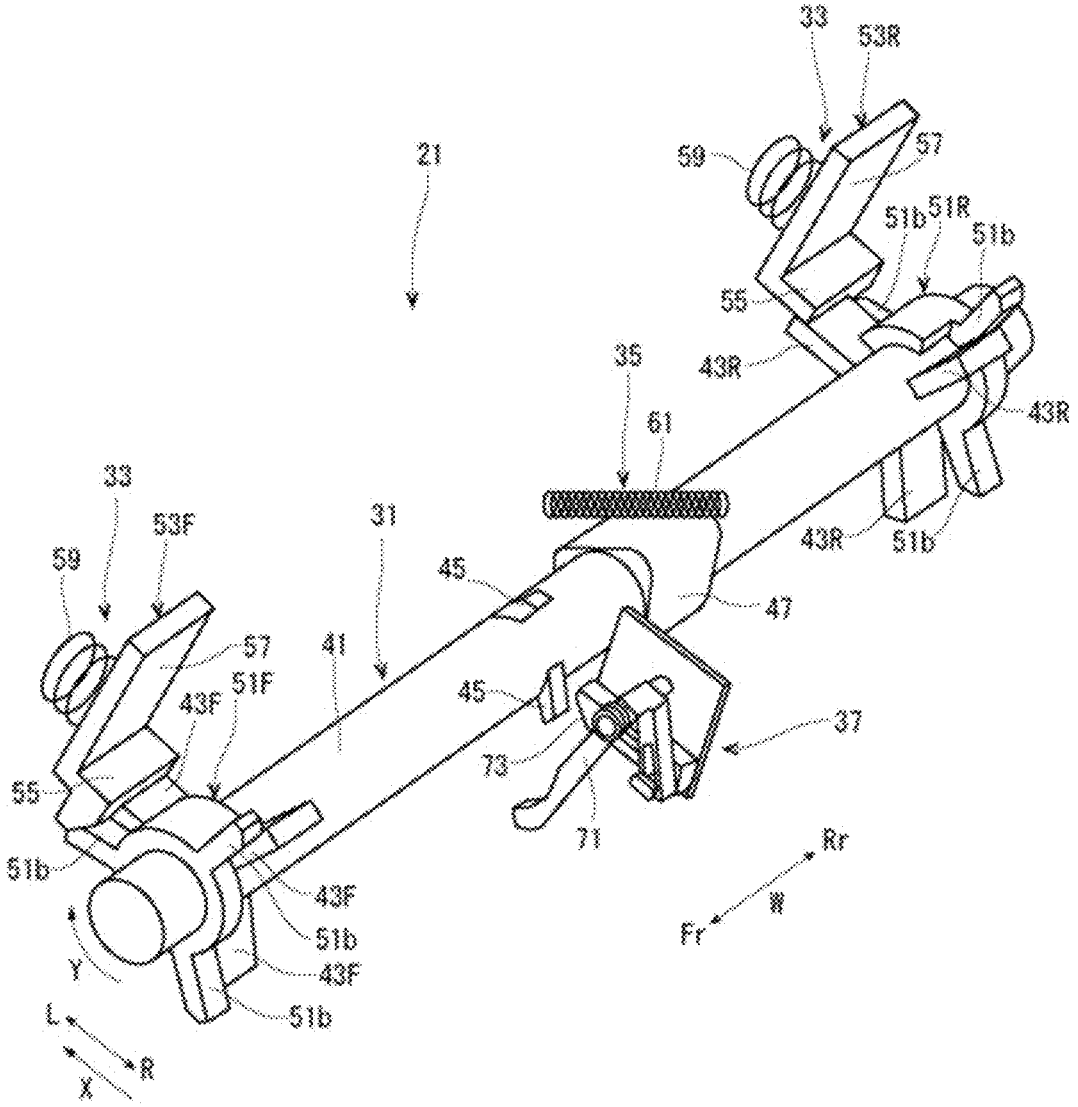
FIG. 2 is a perspective view showing a skew correction mechanism (initial state) of the document conveying apparatus of an embodiment according to the present disclosure.

Next, the skew correction mechanism 21 will be described with reference to FIG. 2. FIG. 2 is a perspective view showing the skew correction mechanism 21.

The skew correction mechanism 21 includes a correction roller 31 that corrects the skew of the document, a correction portion 33 that allows rotation of the correction roller 31 only in a case where the skew of the document was corrected by the correction roller 31, a biasing portion 35 that biases the correction roller 31 in a rotational direction in which the correction roller 31 is rotated by a document conveying force, and a regulating portion 37 that regulates the rotation of the correction roller 31 that is biased by the biasing portion 35. Note that the pinch roller 29 and the drive roller 30 are arranged farther on the outer side in the width direction W than the correction roller 31.

Figure 3:
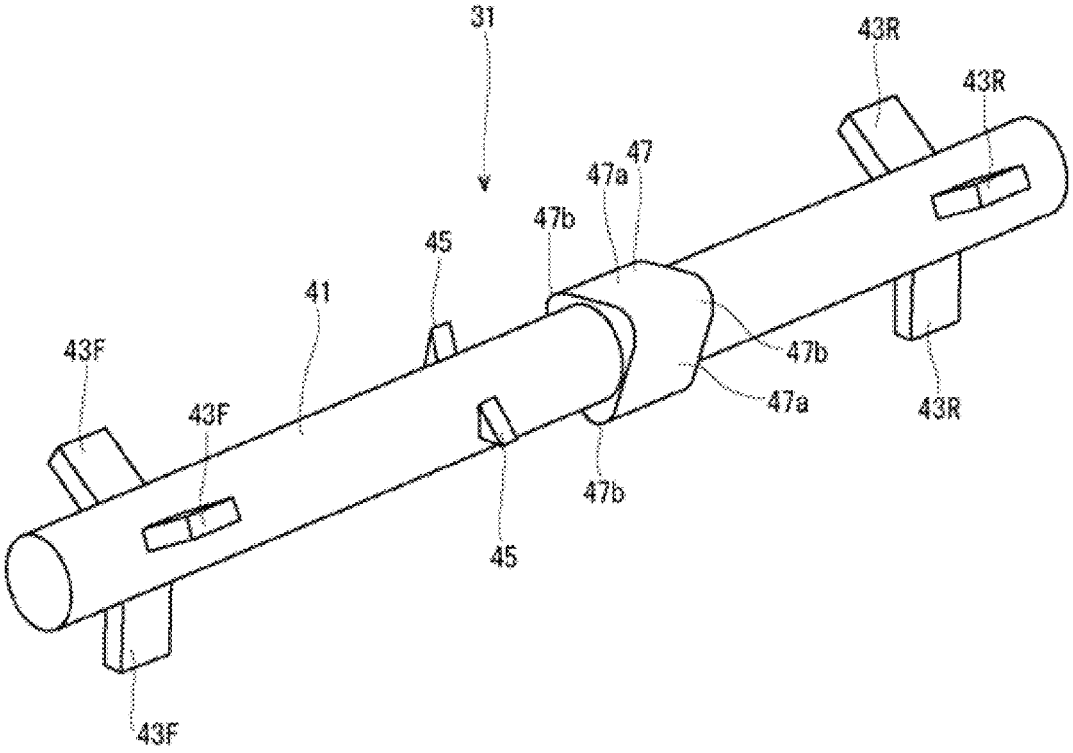
FIG. 3 is a perspective view showing a correction roller of the skew correction mechanism of the document conveying apparatus of an embodiment according to the present disclosure.

First, the correction roller 31 will be described with reference to FIG. 3. FIG. 3 is a perspective view showing the correction roller 31. The correction roller 31 has a rotating shaft 41. Three contact pieces 43F, 43R (contact pieces are collectively referred to as 43) (an example of a pair of contact portions according to the present disclosure) are provided at each of both end portions of the rotating shaft 41, respectively. Each contact piece 43 has a rectangular shape with a predetermined width along an axial direction of the rotating shaft 41 and a predetermined height along a radial direction of the rotating shaft 41, and extends in the radial direction of the rotating shaft 41 from an outer peripheral surface of the rotating shaft 41. The three contact pieces 43 are arranged at regular intervals in a circumferential direction of the rotating shaft 41. In other words, the three contact pieces 43 are arranged at central angles of 120 degrees with respect to the center axis of the rotating shaft 41. Furthermore, the three contact pieces 43F at one end portion and the three contact pieces 43R at the other end portion are arranged at the same circumferential positions. Thus, by both end portions of the document in the width direction W coming into contact with one of the three contact pieces 43 on both end portions of the rotating shaft 41, the leading edge of the document is aligned in the width direction W, or in other words, the skew is corrected. It should be noted that the three contact pieces 43 do not necessarily have to be provided at both end portions of the rotating shaft 41, and may be provided at intervals in the axial direction of the rotating shaft 41.

Furthermore, three locking pieces 45 and a block piece 47 are provided at a central portion of the rotating shaft 41 at predetermined intervals in the axial direction of the rotating shaft 41. The three locking pieces 45 are provided so as to protrude in the radial direction of the rotating shaft 41 and are arranged at regular intervals in the circumferential direction of the rotating shaft 41. In other words, the three locking pieces 45 are arranged at central angles of 120 degrees with respect to the center axis of the rotating shaft 41.

The block piece 47 is formed in a triangular prism shape along the axial direction of the rotating shaft 41 and has three side surfaces 47*a* and three corner surfaces 47*b*. The center axis of the block piece 47 coincides with the center axis of the rotating shaft 41. In addition, the diameter of the inscribed circle of a cross section of the block piece 47 is larger than the diameter of the rotating shaft 41. A corner surface 47*b* between adjacent side surfaces 47*a* is rounded in an R shape.

As shown in FIG. 2, the correction roller 31 is in a posture in which the axial direction of the rotation shaft 41 is along the width direction W, and one of the three contact pieces 43 on both sides (front side and rear side) is positioned so as to cross the conveying path 15 (see FIG. 1). When the leading edge of the document comes into contact with the contact pieces 43 on both sides, the contact pieces 43 are pushed by the document, and the rotating shaft 41 receives the conveying force conveying the document and rotates clockwise in FIG. 2. In the following description, a rotation direction Y indicates a direction in which the rotation shaft 41 rotates by receiving the conveying force of the document.

Next, the correction portion 33 will be described. As described above, the correction portion 33 allows the correction roller 31 to rotate only in a case where the skew of the document was corrected by the correction roller 31. The correction portion 33 includes front and rear lock assisting members 51F, 51R (the lock assisting members are collectively referred to as 51) provided corresponding to the front and rear contact pieces 43F, 43R of the correction roller 31, and front and rear locking members 53F, 53R (locking members are collectively referred to as 53).

Figure 4A:
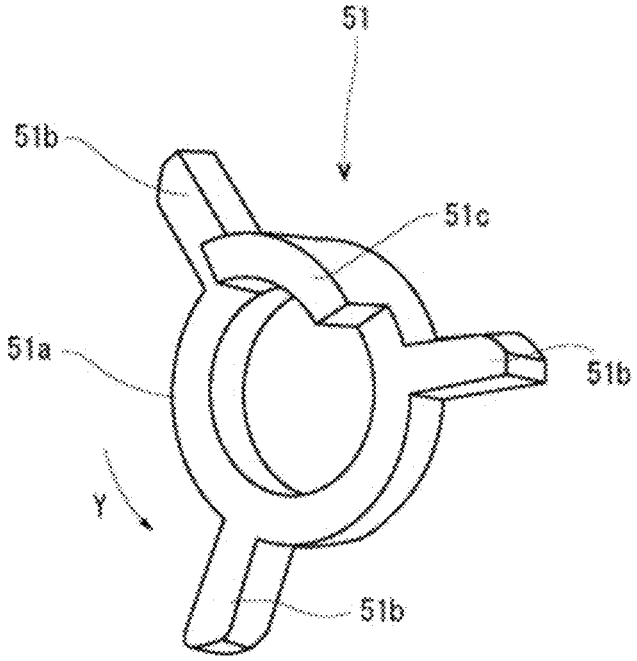
FIG. 4A is a perspective view showing a lock assisting member of the skew correction mechanism of the document conveying apparatus of an embodiment according to the present disclosure.

First, the lock assisting member 51 will be described with reference to FIG. 4A. FIG. 4A is a perspective view showing the lock assisting member 51 on the front side. The lock assisting member 51 has an annular ring portion 51*a* fitted around the outside of the rotating shaft 41 of the correction roller 31, and three releasing pieces 51*b* extending in a radial direction from an outer peripheral surface of the ring portion 51*a*. The three releasing pieces 51*b* are arranged at regular intervals in a circumferential direction of the ring portion 51*a*. In other words, the three releasing pieces 51*b* are arranged at central angles of 120 degrees with respect to the center axis of the ring portion 51*a*. A surface on a downstream side in the rotation direction Y of the tip end of each releasing piece 51*b* is inclined. In addition, at one end surface of the ring portion 51*a* (the rear end surface in the case of the front lock assisting member 51F and the front end surface in the case of the rear lock assisting member 51R) a regulating piece 51*c* extending in the axial direction of the rotating shaft 41 is formed between two adjacent releasing pieces 51*b*. The length of the regulating piece 51*c* along the circumferential direction of the ring portion 51*a* is shorter than the length between the adjacent releasing pieces 51*b*. In addition, a predetermined gap is provided between both side surfaces in the circumferential direction of the regulating piece 51*c* and the side surfaces of the two adjacent releasing pieces 51*b*.

As shown in FIG. 2, the front and rear lock assisting members 51F, 51R are arranged adjacent to the front and rear contact pieces 43F, 43R of the rotating shaft 41 of the correction roller 31. That is, the ring portion 51*a* of the lock assisting member 51 is fitted onto the rotating shaft 41 from farther on the outer side than the contact pieces 43, and the regulating piece 51*c* is inserted between the adjacent contact pieces 43. Thus, the lock assisting member 51 is rotatable together with the rotating shaft 41, on the other hand, rotates with respect to the rotating shaft 41 within a range in which the regulating piece 51*c* comes in contact with the contact pieces 43 adjacent in the circumferential direction.

Figure 4B:
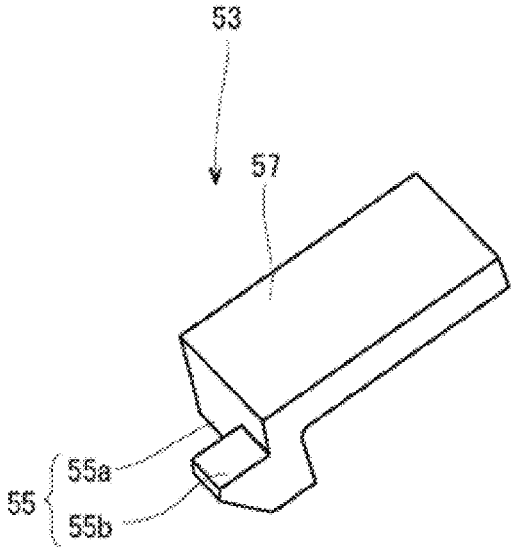
FIG. 4B is a perspective view showing a locking member of the skew correction mechanism of the document conveying apparatus of an embodiment according to the present disclosure.

Next, the locking member 53 will be described with reference to FIG. 4B. FIG. 4B is a perspective view showing the locking member 53 on the front side. The locking member 53 is an L-shaped member when viewed from the axial direction of the rotating shaft 41 of the correction roller 31, and has a rectangular plate-shaped interference portion 55 and a support portion 57 which are provided orthogonal to each other. The interference portion 55 has a regulating portion 55*a* and a pressed portion 55*b* that are arranged in the width direction. The pressed portion 55*b* is formed to be thicker than the regulating portion 55*a*. In addition, the end surface of the pressed portion 55*b* is inclined.

As shown in FIG. 2, the locking member 53 is arranged so that the interference portion 55 overlaps a rotation trajectory of the contact pieces 43 of the correction roller 31 and the releasing pieces 51*b* of the lock assisting member 51. More specifically, the regulating portion 55*a* of the interference portion 55 overlaps the rotation trajectory of the contact pieces 43 of the correction roller 31, and the pressed portion 55*b* overlaps the rotation trajectory of the releasing pieces 51*b* of the lock assisting member 51. That is, when the rotating shaft 41 rotates in the rotation direction Y, the contact piece 43 of the correction roller 31 comes in contact with the regulating portion 55*a* of the interference portion 55, and an inclined surface of the releasing piece 51*b* of the lock assisting member 51 comes in contact with an inclined surface of the pressed portion 55*b* of the interference portion 55. The pressed portion 55*b* is thicker than the regulating portion 55*a*, and thus the releasing piece 51*b* comes in contact with the pressed portion 55*b* farther on the upstream side in the rotational direction Y than the contact piece 43. Thus, the releasing piece 51*b* is positioned farther on the upstream side in the rotation direction Y than the contact piece 43.

Furthermore, the support portion 57 of the locking member 53 is supported via a coil spring 59, and the interference portion 55 is able to move in the radial direction of the rotating shaft 41 of the correction roller 31. When the support portion 57 moves radially outward against the biasing force of the coil spring 59, the interference portion 55 of the locking member 53 separates from the contact piece 43 and the releasing piece 51*b*.

Figure 5A:
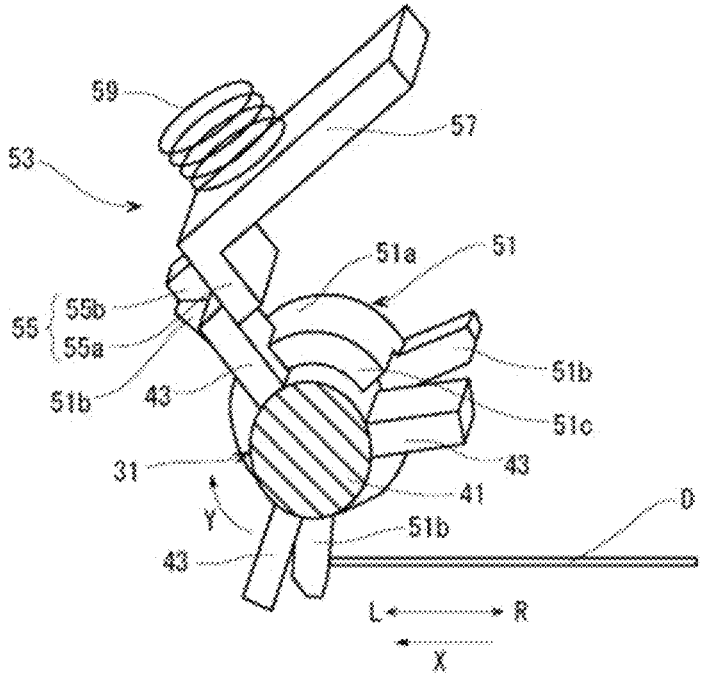
FIG. 5A is a perspective view for describing a skew correction operation (a state in which a leading edge of a document is in contact with a releasing piece) in the skew correction mechanism of the document conveying apparatus of an embodiment according to the present disclosure.
Figure 5B:
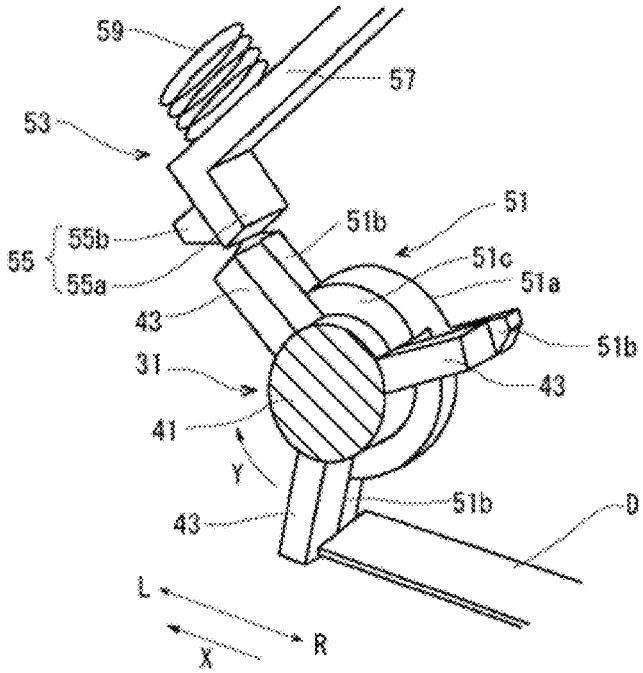
FIG. 5B is a perspective view for describing a skew correction operation (a state in which the locking member moved) in the skew correction mechanism of the document conveying apparatus of an embodiment according to the present disclosure.

Next, the skew correction operation by the correction portion 33 will be described with reference to FIG. 2, FIG. 5A, and FIG. 5B. FIG. 5A shows a state in which the leading edge of the document D is in contact with the releasing piece 51*b*, and FIG. 5B shows a state in which the locking member 53 has moved. As shown in FIG. 5A, the correction roller 31 is arranged in a posture (initial posture) in which one each of the three front and rear contact pieces 43 crosses the conveying path 15. At this time, as described above, the releasing piece 51*b* of the lock assisting member 51 is positioned farther on the upstream side in the rotational direction Y than the contact piece 43 of the correction roller 31, and thus the releasing piece 51*b* is positioned farther on the upstream side in the conveying direction X than the contact piece 43.

In a case where the document D conveyed on the conveying path 15 is skewed, one end portion (the rear end in this example) of the leading edge of the document D reaches the correction roller 31. Then, as shown in FIG. 5A, the leading edge of the document D first comes in contact with the releasing piece 51*b* of the lock assisting member 51. The document D is applied with a conveying force by the sheet feed unit 17, and thus the releasing piece 51*b* is pushed by the document D, and the lock assisting member 51 (ring portion 51*a*) rotates with respect to the rotating shaft 41. As shown in FIG. 5B, the lock assisting member 51 rotates until the leading edge of the document D comes in contact with the contact piece 43.

When the lock assisting member 51 rotates, the pressed portion 55*b* of the interference portion 55 of the locking member 53 is pressed by the releasing piece 51*b*, and as shown in FIG. 5B, the locking member 53 moves against the biasing force of the coil spring 59, and the interference portion 55 (regulating portion 55*a*) is separated from the contact piece 43. In this way, the locking member 53 is separated from the contact piece 43 at the rear end portion; however, the contact piece 43 is in contact with the interference portion 55 of the locking member 53 at the front end portion, and thus the correction roller 31 does not rotate.

After that, the front end portion of the leading edge of the document D similarly comes in contact with the releasing piece 51*b* of the lock assisting member 51, and the lock assisting member 51 rotates until the leading edge of the document D comes in contact with the contacting piece 43. In this way, both end portions of the leading edge of the document D come in contact with the contact pieces 43, and thus the skew of the document D is corrected. In addition, the locking member 53 is moved by the rotation of the releasing piece 51*b*, and the interference portion 55 is separated from the contact piece 43. After the skew of the document D has been corrected in this way, the correction roller 31 is allowed to rotate.

Figure 6:
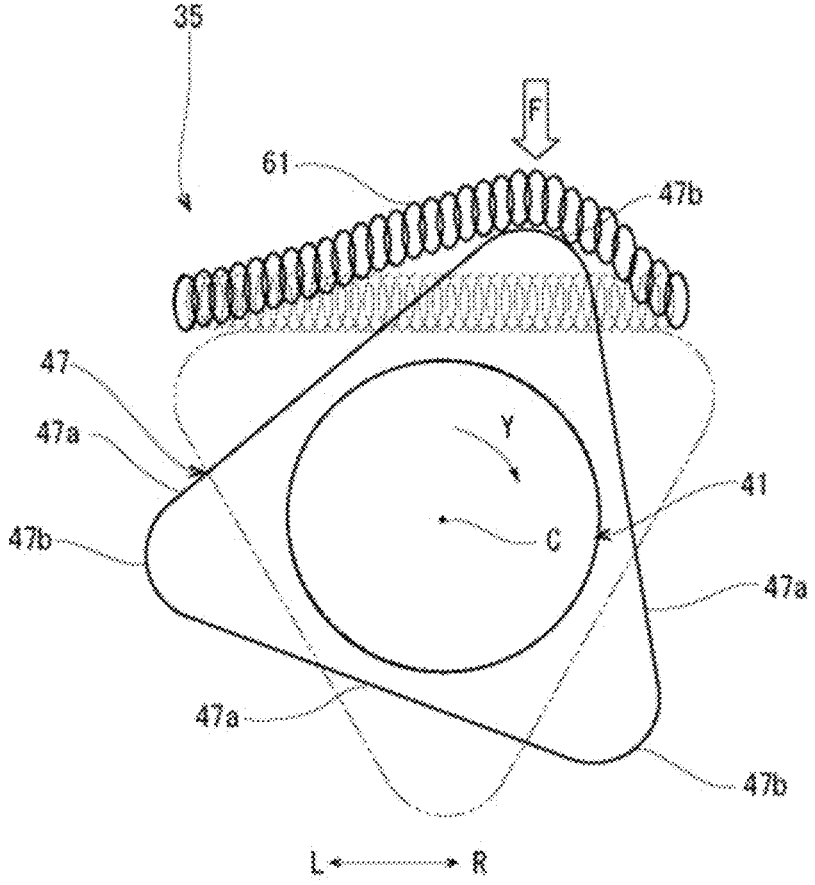
FIG. 6 is a diagram for describing a rotation operation of a block piece in the skew correction mechanism of the document conveying apparatus of an embodiment according to the present disclosure.

Next, the biasing portion 35 will be described with reference to FIG. 2 and FIG. 6. FIG. 6 is a diagram schematically showing the block piece 47 and a spring roller 61. As described above, the biasing portion 35 biases the correction roller 31 in the rotation direction Y in which the correction roller 31 is rotated by the document conveying force. As shown in FIG. 2, the biasing portion 35 includes the block piece 47 provided on the correction roller 31 and the spring roller 61 that applies resistance to the block piece 47. The spring roller 61 is a tension spring, and both ends are supported by a frame member (not shown). The spring roller 61 is in contact with one side surface 47*a* of the block piece 47 along the conveying direction X. Thus, the rotation of the correction roller 31 is regulated, and the correction roller 31 is positioned in a predetermined posture (for example, initial posture).

On the other hand, when the correction roller 31 rotates, the spring roller 61 slides along an outer peripheral surface (side surface 47*a* and the corner surface 47*b*) of the block piece 47, and as shown in FIG. 6, one of the corner surfaces 47*b* of the block piece 47 pushes up the spring roller 61. The spring roller 61 is stretched and elastically deformed by being pushed up, and a force F is applied from the spring roller 61 to the block piece 47. Here, in a case where a center axis of the block piece 47 (center axis C of the rotating shaft 41 of the correction roller 31) is deviated with respect to the direction of the force F applied from the spring roller 61, the block piece 47, that is, the correction roller 31 rotates. As shown in FIG. 6, in a case where the center axis C of the block piece 47 deviates to the upstream side in the rotation direction Y with respect to the direction of the force F applied from the spring roller 61, the block piece 47, that is, the correction roller 31 rotates in the rotation direction Y. At this time, the block piece 47 rotates until another side surface 47*a* comes into contact with the spring roller 61 (see the two-dot chain line in FIG. 6). That is, the correction roller 31 rotates in 120-degree increments.

Figure 7A:
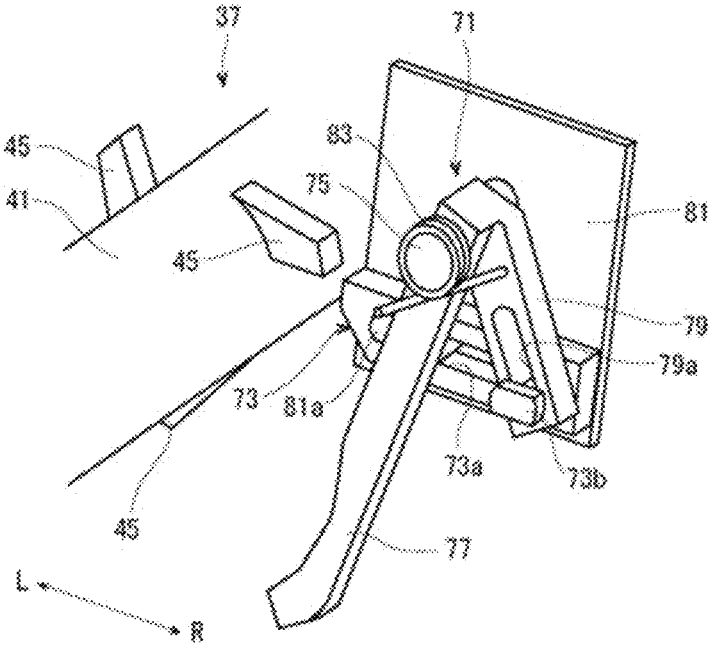
FIG. 7A is a perspective view showing a regulating portion (actuator and stopper (initial state)) of the skew correction mechanism of the document conveying apparatus of an embodiment according to the present disclosure.
Figure 7B:
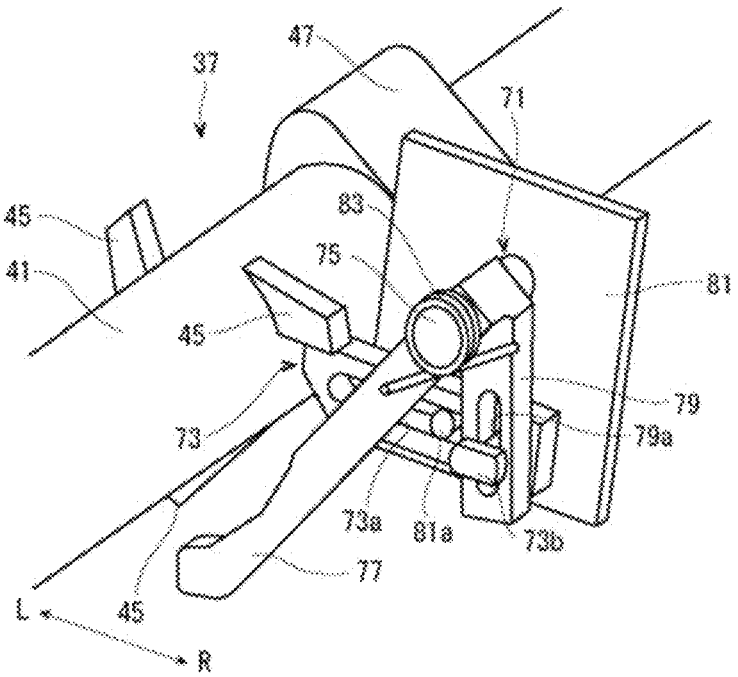
FIG. 7B is a perspective view showing the regulating portion (actuator and stopper (actuator rotation state)) of the skew correction mechanism of the document conveying apparatus of an embodiment according to the present disclosure.

Next, the regulating portion 37 will be described with reference to FIG. 2, FIG. 7A, and FIG. 7B. FIG. 7A and FIG. 7B are perspective views showing the regulating portion 37. As described above, the regulating portion 37 regulates the rotation of the correction roller 31 biased by the biasing portion 35. The regulating portion 37 includes a locking piece 45 provided on the rotating shaft 41 of the correction roller 31, an actuator 71 rotated by the conveyed document, and a stopper 73 moving forward and backward in conjunction with the actuator 71.

As shown in FIG. 7A and FIG. 7B, the actuator 71 has a rotating shaft 75 and an actuator arm 77 and a link arm 79 extending in the radial direction from the rotating shaft 75. The actuator arm 77 and the link arm 79 are arranged with a predetermined central angle with respect to the center axis of the rotating shaft 75 therebetween. A slit 79*a* is formed in the link arm 79 along the longitudinal direction. As shown in FIG. 2, the actuator 71 is arranged farther on the upstream side in the conveying direction X than the correction roller 31. The rotating shaft 75 of the actuator 71 is rotatably supported by a support plate 81 in a posture along the width direction W The actuator 71 is maintained, by a torsion coil spring 83 provided on the rotating shaft 75, in a posture (initial posture, FIG. 7A) in which the actuator arm 77 hangs down on the conveying path 15 and the link arm 79 extends farther toward the upstream side in the conveying direction X than the actuator arm 77.

The stopper 73 is supported by the support plate 81 so as to be able to move back and forth along the conveying direction X. A plurality of pins 81*a* protruding in the width direction W are arranged side by side in the conveying direction X on the support plate 81. A slit 73*a* is formed in the stopper 73 along the longitudinal direction. A pin 81*a* is inserted into the slit 73*a*. Thus, the stopper 73 moves forward or backward in the conveying direction X while being guided by the pin 81*a*.

At a rear end portion of the stopper 73 (the end portion on the upstream side in the conveying direction X), an engaging pin 73*b* protrudes in the width direction W. The engaging pin 73*b* is inserted into the slit 79*a* of the link arm 79 of the actuator 71 and is prevented from coming out. When the actuator arm 77 rotates about the rotating shaft 75, the link arm 79 rotates together with the actuator arm 77. Then, the engaging pin 73*b* is pushed by a side surface of the slit 79*a* of the link arm 79, and the stopper 73 moves forward or backward.

As shown in FIG. 7A, the actuator 71 rotates to the initial posture while the document is not being conveyed. That is, the actuator arm 77 hangs down on the conveying path 15 and the stopper 73 moves backward. As shown in FIG. 7B, when the actuator arm 77 is pushed by the leading edge of the document and the rotating shaft 75 rotates clockwise, the stopper 73 is pushed by the link arm 79, and the stopper 73 moves forward.

The stopper 73 moves forward until the tip end comes close to the rotating shaft 41 of the correction roller 31. Then, in a case where the rotating shaft 41 is rotating, the locking piece 45 provided on the rotating shaft 41 comes into contact with the tip end portion of the stopper 73, and the rotation of the rotating shaft 41 stops. That is, the correction roller 31 stops rotating.

On the other hand, when the document is separated from the actuator arm 77, the actuator 71 is rotated to the initial posture by the torsion coil spring 83, and the stopper 73 moves backward. Thus, the stopper 73 is separated from the locking piece 45 and the correction roller 31 is able to rotate.

In the document conveying apparatus 1 having the above configuration, the skew correction operation by the skew correction mechanism will be described with reference to FIG. 2 and FIG. 8 to FIG. 11. FIG. 8 to 11 are perspective views showing the skew correction mechanism. In the initial state shown in FIG. 2, the correction roller 31 is positioned by the biasing portion 35 in an initial posture in which one each of the front and rear contact pieces 43F and 43R crosses the conveying path 15. Another one each of the front and rear contact pieces 43F and 43R comes in contact with the regulating portion 55*a* of the interference portion 55 of the front and rear locking members 53F and 53R, and one releasing piece 53*b* of the front and rear lock assisting members 51F and 51R comes in contact with the pressed portion 55*b* of the interference portion 55 of the front and rear locking members 53F and 53R. In addition, in the regulating portion 37, the actuator 71 rotates to the initial posture.

Figure 8:
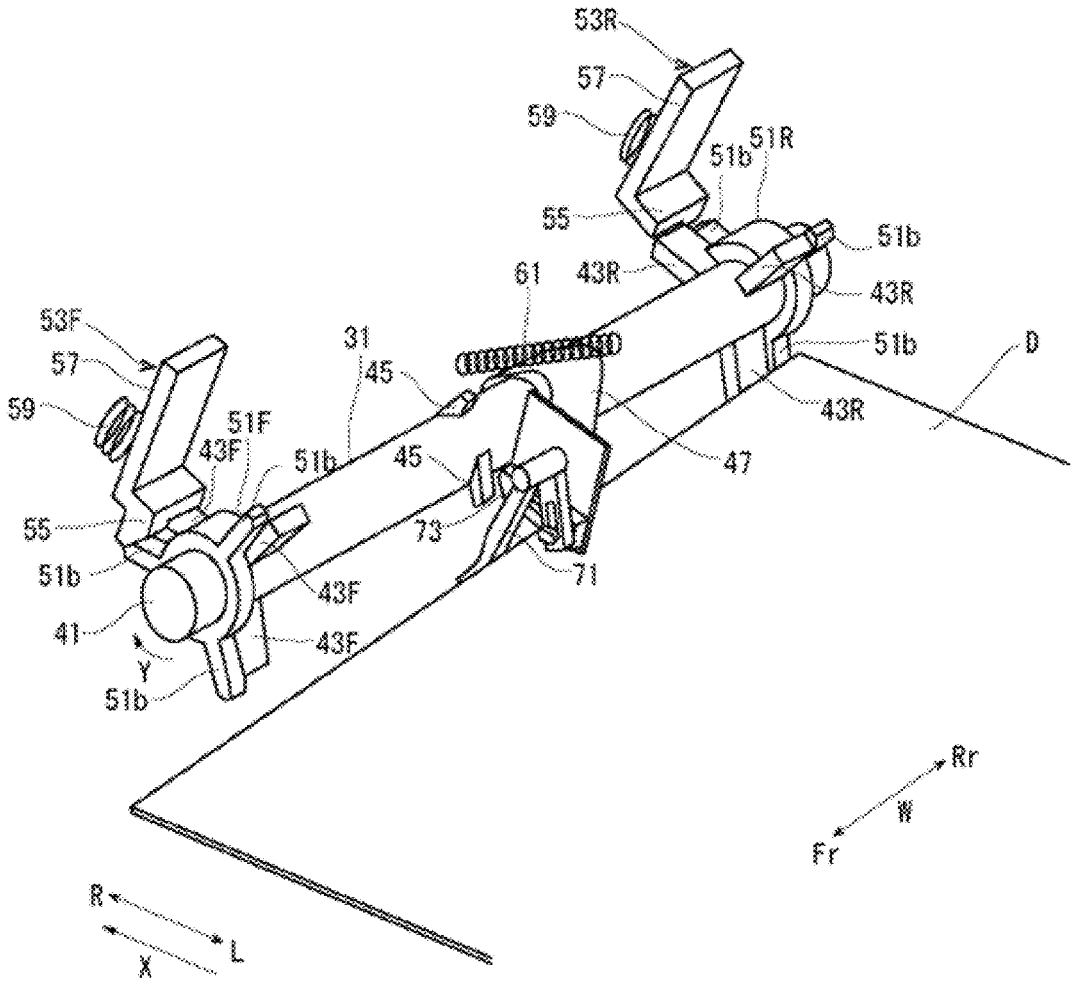
FIG. 8 is a perspective view showing a skew correction mechanism (contact state in which a skewed document is conveyed) of the document conveying apparatus of an embodiment according to the present disclosure.

As shown in FIG. 8, in a case where the document D conveyed on the conveying path 15 is skewed, one end portion of the leading edge of the document D (the rear end portion in this example) reaches the skew correction mechanism first. Then, as described above with reference to FIG. 5A and FIG. 5B, the leading edge of the document D first comes into contact with the releasing piece 51*b* of the lock assisting member 51R on the rear side. The releasing piece 51*b* is pushed by the document D and rotates with respect to the rotating shaft 41. The releasing piece 51*b* rotates until the leading edge of the document D comes into contact with one of the contact pieces 43R on the rear side of the correction roller 31. In addition, when the releasing pieces 51*b* rotate, the pressed portions 55*b* of the locking members 53 are pressed by the releasing pieces 51*b*, the locking members 53 move, and the regulating portions 55*a* separate from the contact pieces 43.

Figure 9:
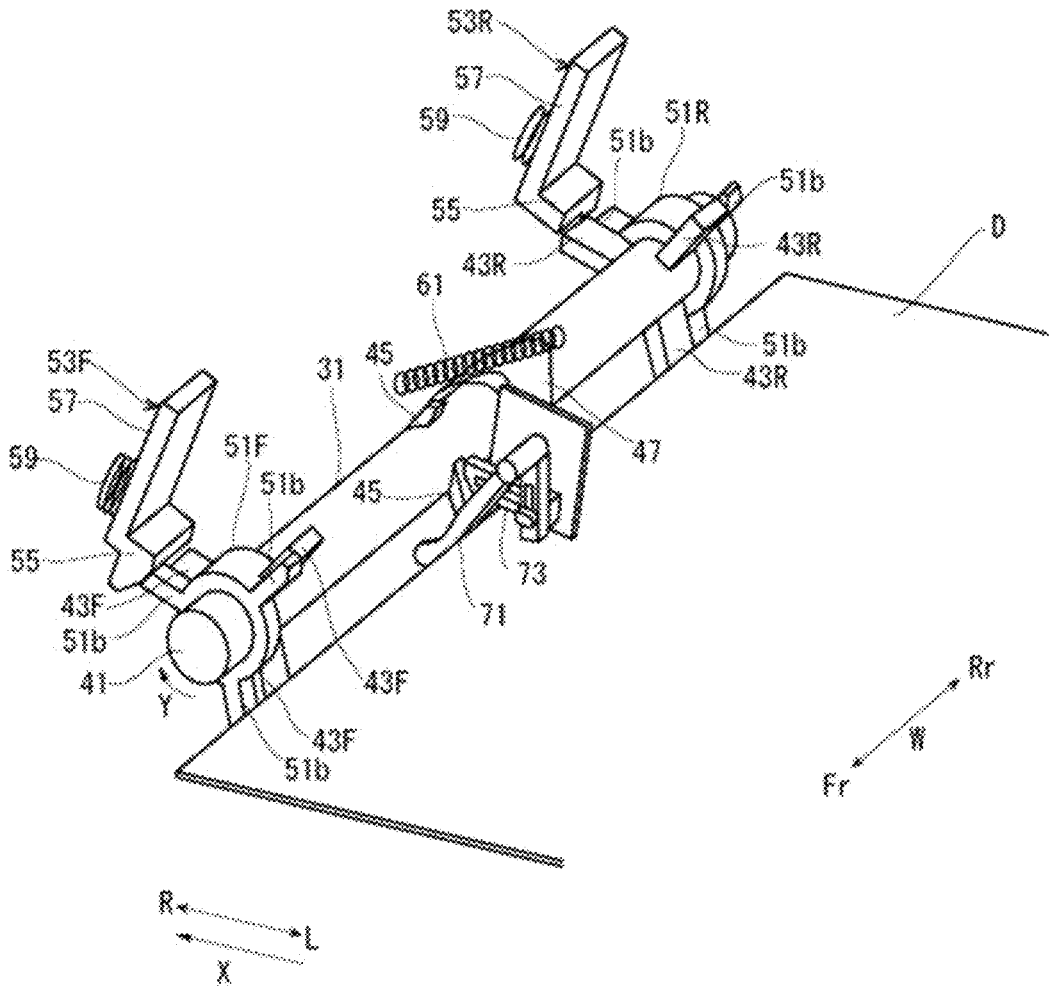
FIG. 9 is a perspective view showing the skew correction mechanism (state in which the skew of the document is corrected) of the document conveying apparatus of an embodiment according to the present disclosure.

Thereafter, as shown in FIG. 9, the front end portion of the leading edge of the document D comes in contact with the releasing piece 51*b* of the lock assisting member 51 on the front side. The releasing piece 51*b* is pushed by the document D and rotates with respect to the rotating shaft 41. The releasing piece 51*b* rotates until the leading edge of the document D comes in contact with one of the contact pieces 43F on the front side of the correction roller 31. Thus, the front and rear end portions of the document D come into contact with the contact pieces 43, and thus the skew of the document D is corrected. In addition, when the releasing pieces 51*b* rotate, the pressed portions 55*b* of the locking members 53 are pressed by the releasing pieces 51*b*, the locking members 53 move, and the regulating portions 55*a* separate from the contact pieces 43. As a result, the correction roller 31 is allowed to rotate.

Furthermore, the leading edge of the document D comes in contact with the actuator arm 77 of the actuator 71 and pushes the actuator arm 77. Thus, the rotating shaft 75 of the actuator 71 rotates in the clockwise direction in the figure, and the link arm 79 rotates. Then, the engaging pin 73*b* is pushed by the side surface of the slit 79*a* of the link arm 79, and the stopper 73 moves forward.

Figure 10:
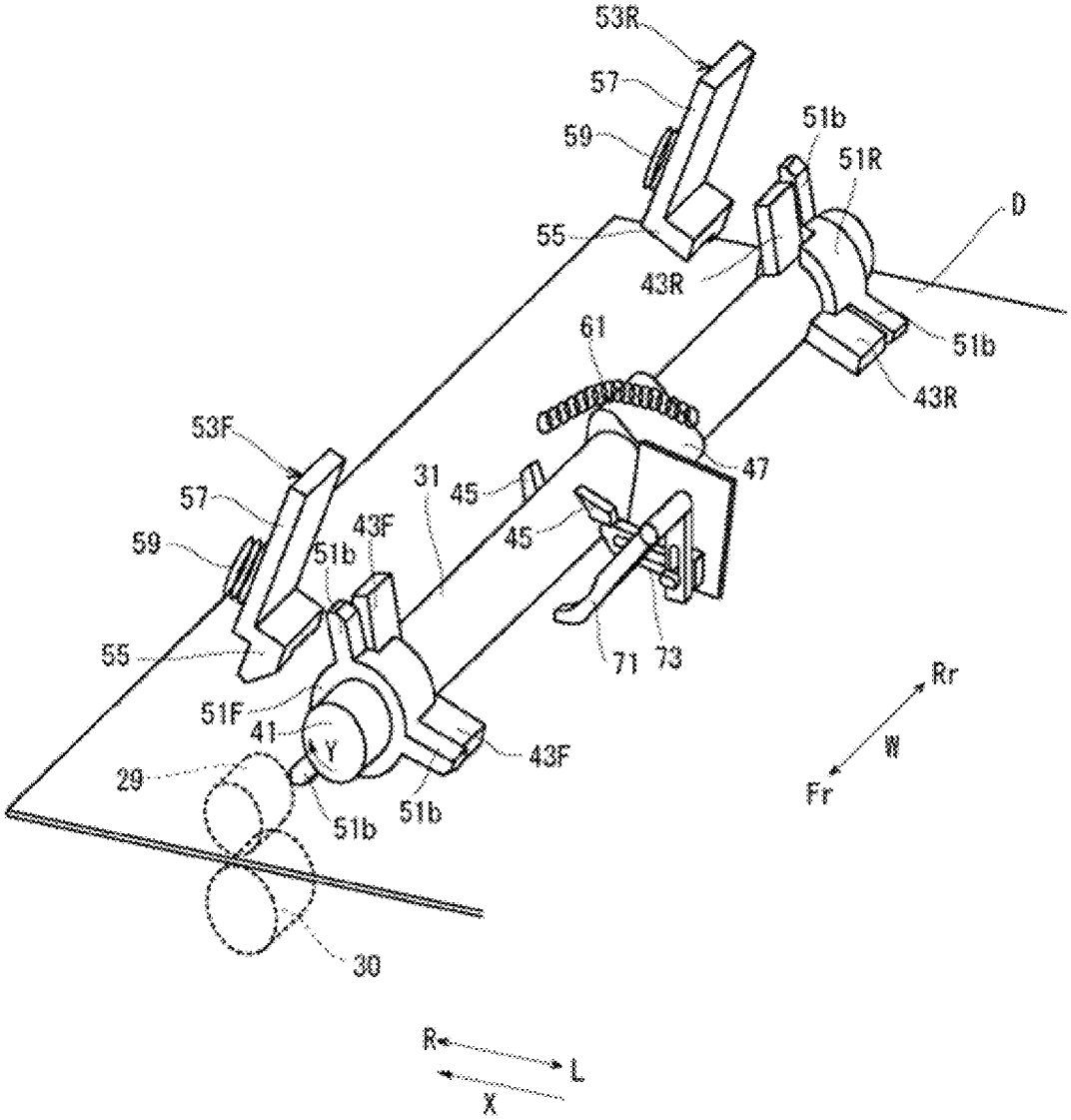
FIG. 10 is a perspective view showing a skew correction mechanism (conveyance state in which a contact piece of a correction roller is retracted from a conveying path) of the document conveying apparatus of an embodiment according to the present disclosure.

As shown in FIG. 10, when the correction roller 31 is allowed to rotate, the contact pieces 43 are pushed by the leading edge of the document D, and the correction roller 31 rotates. The correction roller 31 rotates until the leading edge of the document D is separated from the contact pieces 43. The leading edge of the document D is pinched between the pinch roller 29 and the drive roller 30 before separating from the contact pieces 43 (only the pinch roller 29 and the drive roller 30 arranged on the front side are shown in FIG. 10). In this way, even when the leading edge of the document D is separated from the contact pieces 43, the document D is nipped between the pinch roller 29 and the driving roller 30, and thus the skew of the document D is corrected before being conveyed to the second conveying roller pair 23. In addition, the contact pieces 43 and the releasing pieces 51*b* are separated from the interference portions 55 of the locking members 53, and thus the locking members 53 are biased by the coil springs 59 and move closer to the correction roller 31.

Furthermore, when the correction roller 31 rotates, the block piece 47 also rotates integrally with the rotating shaft 41. Then, as shown in FIG. 6, the corner surface 47*b* of the block piece 47 pushes the spring roller 61 up. Here, when the correction roller 31 rotates until the leading edge of the document D is separated from the contact pieces 43, the contact pieces 43 and the block piece 47 are positioned in the circumferential direction of the rotating shaft 41 so that the corner surface 47*b* of the block piece 47 rotates farther toward the downstream side in the rotation direction Y than the center axis C of the rotating shaft 41 of the correction roller 31 (see FIG. 6). Then, a force causing the block piece 47 to rotate in the rotation direction Y is applied by the spring roller 61.

Figure 12:
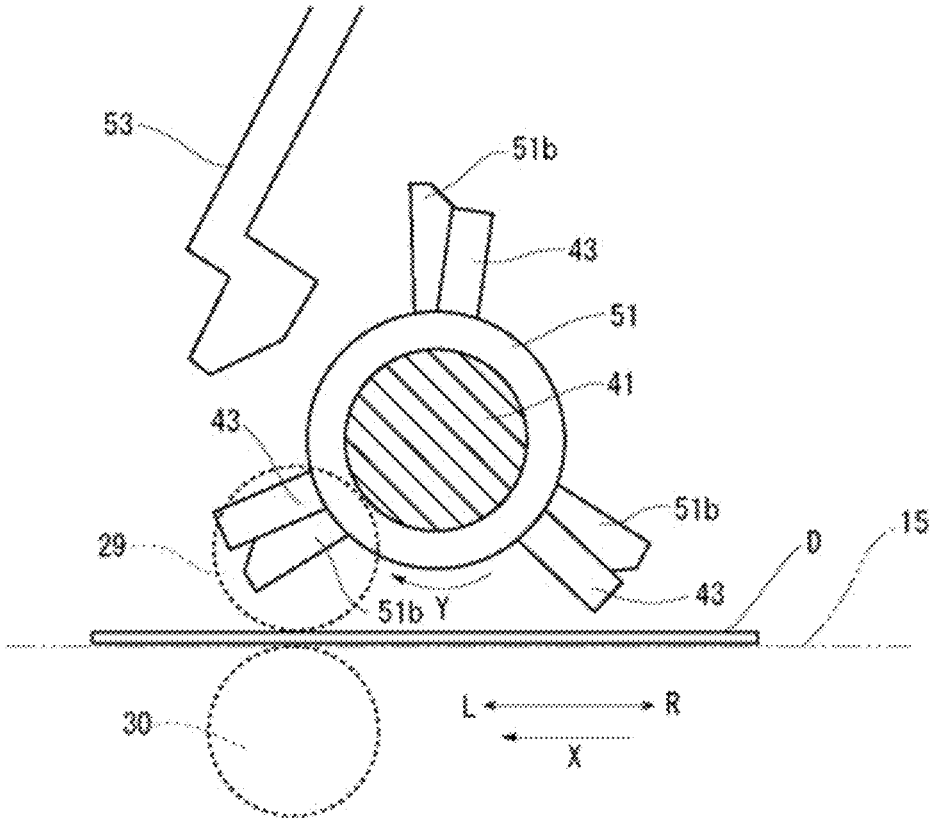
FIG. 12 is a cross-sectional view showing the correction roller rotated by a biasing portion in the document conveying apparatus of an embodiment according to the present disclosure.

When the correction roller 31 rotates, the locking piece 45 provided on the rotating shaft 41 eventually comes into contact with the stopper 73 that has moved forward, and the rotation of the correction roller 31 stops. Here, as shown in FIG. 12, the locking pieces 45 and the block piece 47 are positioned in the circumferential direction of the rotating shaft 41 so that the rotation of the correction roller 31 is stopped in a position in which the contact pieces 43 and the releasing pieces 51*b* are sufficiently retracted from the conveying path 15 so as not to interfere with the conveying of the document.

As described above, after the locking members 53 are separated from the contact pieces 43, the correction roller 31 rotates until the leading edge of the document D is separated from the contact pieces 43. In this state, the tip ends of the contact pieces 43 are in contact with the document D, and thus the contact pieces 43 apply a load to the conveying of the document D, preventing the document D from being conveyed smoothly. Therefore, after the biasing portion 35 rotates the correction roller 31 so that the contact pieces 43 and the releasing pieces 51*b* retracts from the conveying path 15, the regulation portion 37 regulates the rotation of the correction roller 31.

Figure 11:
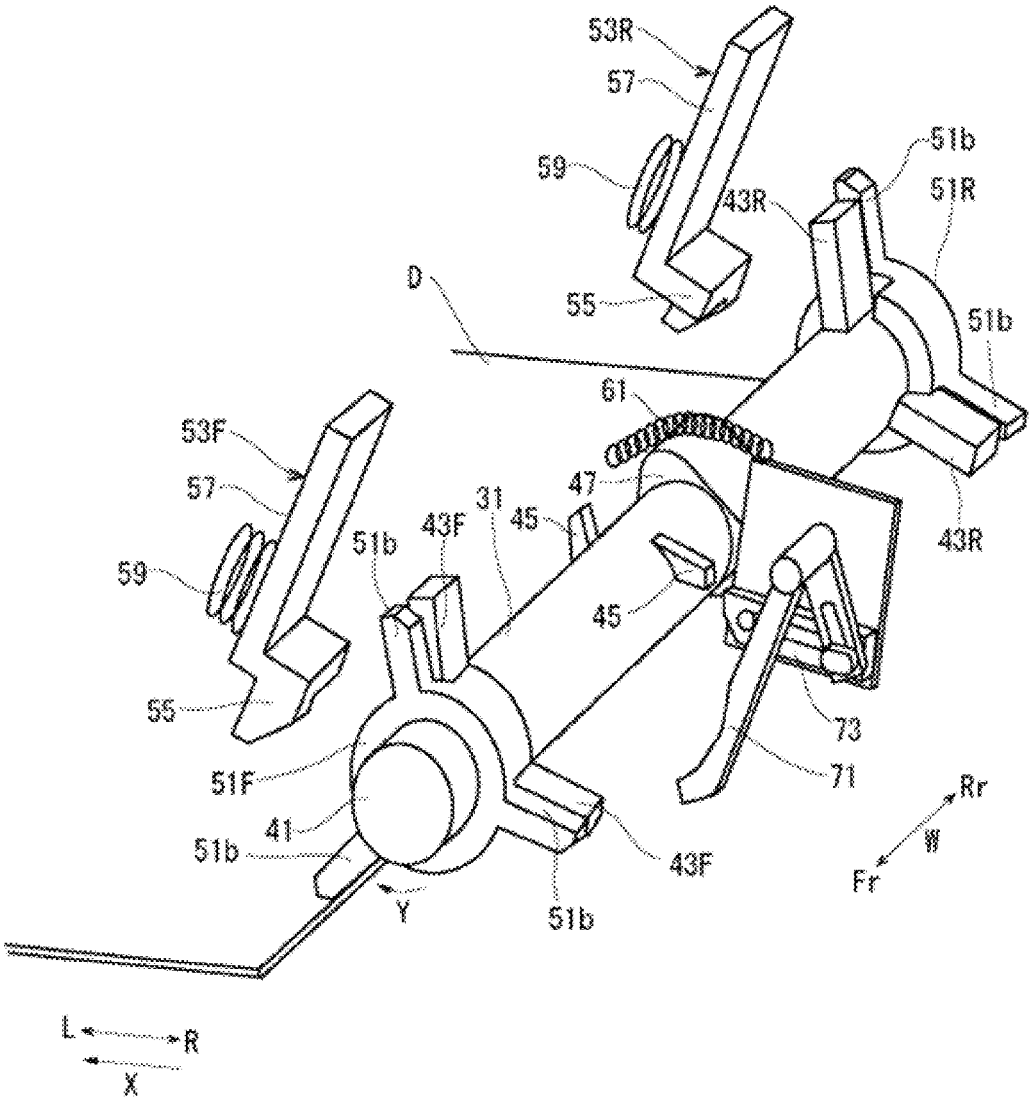
FIG. 11 is a perspective view showing a skew correction mechanism (state in which a document has passed the actuator) of the document conveying apparatus of an embodiment according to the present disclosure.

As shown in FIG. 11, when the document D is separated from the actuator 71, the actuator 71 is biased by the torsion coil spring 83 and rotates to the initial posture. Then, the stopper 73 moves backward, allowing the correction roller 31 to rotate. The correction roller 31 rotates until the spring roller 61 comes in contact with the side surface 47*a* of the block piece 47. Then, the contact pieces 43 comes in contact with the regulating portions 55*a* of the interference portions 55 of the locking members 53, and the releasing pieces 51*b* of the lock assisting members 51 comes in contact with the pressed portions 55*b*. Thus, the correction roller 31 returns to the initial posture shown in FIG. 2.

As described above, with the document conveying apparatus 1 according to the present disclosure, the skew of a document can be corrected without using a registration roller pair driven by an electromagnetic clutch. That is, the document is conveyed after the skew of the document is corrected using the conveying force of the document conveyed on the conveying path 15, and thus the need to use an electromagnetic clutch for controlling stopping and restarting of conveying of the document during skew correction is eliminated. Therefore, the cost of the document conveying apparatus 1 can be reduced.

More specifically, after the skew of the document is corrected by the correction roller 31, the correction portion 33 allows the correction roller 31 to rotate, the biasing portion 35 causes the correction roller 31 to rotate, and the regulating portion 37 regulates the rotation of the correction roller 31 so that the contact pieces 43 are retracted from the conveying path 15.

In addition, the regulating portion 37 includes the actuator 71 that rotates according to the conveyed document, and thus it is possible to rotate the correction roller 31 or regulate the rotation at an appropriate timing according to the conveying of the document.

Moreover, the number of contact pieces 43 and the number of corners of the block piece 47 are preferably the same. Furthermore, the contact pieces 43 are provided at central angles of 120 degrees with respect to the axis of the rotating shaft 41, and the biasing portion 35 biases the correction roller 31 so as to rotate by 120 degrees at a time, and thus the contact pieces 43 can be reliably retracted from the conveying path 15.

The skew adjustment mechanism according to the present disclosure may also be used for skew correction of sheets conveyed by an image forming apparatus.

Although the technique according to the present disclosure has been described with respect to certain embodiments, the technique according to the present disclosure is not limited to the embodiments described above. A person skilled in the art could modify the above embodiments without departing from the scope and spirit of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A document conveying apparatus, comprising:

a conveying path along which documents are conveyed in a predetermined conveying direction;

a correction roller comprising a rotating shaft along a width direction perpendicular to the conveying direction, and a pair of contact portions including contact pieces that are arranged on the rotating shaft spaced apart in the width direction and extending in radial directions from the same positions in the circumferential direction, each of the contact portions being capable of coming in contact with a leading edge of a document conveyed on the conveying path;

a correction portion configured to allow the correction roller to rotate due to a document conveying force applied to the pair of contact portions only in a case where skew of the document was corrected by the leading edge of the document conveyed on the conveying path coming in contact with both of the pair of contact portions;

a biasing portion configured to bias the correction roller in a rotational direction in which the correction roller is rotated by the document conveying force; and a regulating portion configured to regulate rotation of the correction roller biased by the biasing portion so as to cause the contact pieces of the contact portions to retract from the conveying path, wherein the regulating portion comprises:

an actuator that is arranged farther on an upstream side in the conveying direction than the correction roller and configured to rotate when the leading edge of the document conveyed on the conveying path comes in contact with the actuator;

a stopper configured to move forward or backward according to a rotation of the actuator; and engaging pieces provided at predetermined intervals along the circumferential direction of the rotating shaft of the correction roller and capable of engaging with the stopper, in a state where the actuator is not rotating, the stopper moves backward and separates from the engaging piece, and when the leading edge of the document comes into contact with the actuator and the actuator rotates, the stopper moves forward and engages with the engaging piece, thereby regulating rotation of the correction roller.

2. The document conveying apparatus according to claim 1, wherein the correction portion comprises:

a lock assisting member including: a ring portion fitted on the rotating shaft adjacent to the contact portion of the correction roller in the axial direction of the rotating shaft, and configured to be rotatable together with the rotating shaft and rotatable with respect to the rotating shaft within a predetermined range; and a plurality of releasing pieces extending in a radial direction from the ring portion; and locking members configured to come in contact with the contact portions of the correction roller to regulate rotation of the correction roller, and to be movable away from the contact portions by being pushed by one of the plurality of releasing pieces;

in a state where the document is not being conveyed on the conveying path, the releasing pieces are positioned farther on the upstream side in the conveying direction than contact pieces of the contact portions, and the locking members come in contact with the contact portions to restrict rotation of the correction roller; and when one of the plurality of releasing pieces is pushed by the document conveyed on the conveying path, the ring portion rotates about the rotating shaft, and another one of the plurality of releasing pieces pushes the locking member to separate the locking member from the contact portion, allowing the correction roller to rotate.

3. The document conveying apparatus according to claim 1, wherein the contact portion includes three contact pieces provided at central angles of 120 degrees with respect to the center axis of the rotating shaft; and the biasing portion biases the correction roller to rotate by 120 degrees at a time.

* * * * *